US011732614B2

(12) United States Patent
Massicotte et al.

(10) Patent No.: US 11,732,614 B2
(45) Date of Patent: Aug. 22, 2023

(54) GAS TURBINE ENGINE CASE FIXTURE ASSEMBLY WITH PLATFORM ADAPTOR

(71) Applicant: Pratt & Whitney Canada Corp., Longueuil (CA)

(72) Inventors: Francois Massicotte, Laval (CA); Alexandre Marsan, Longueuil (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 17/562,558

(22) Filed: Dec. 27, 2021

(65) Prior Publication Data

US 2023/0203965 A1 Jun. 29, 2023

(51) Int. Cl.
*F01D 25/28* (2006.01)

(52) U.S. Cl.
CPC ..... *F01D 25/285* (2013.01); *F05D 2220/32* (2013.01); *F05D 2230/60* (2013.01); *F05D 2240/14* (2013.01); *F05D 2240/91* (2013.01); *F05D 2260/02* (2013.01)

(58) Field of Classification Search
CPC ..... F01D 25/285; F05D 2260/02; F05D 2240/14; B25J 11/005–007; B23K 37/0461
See application file for complete search history.

(56) References Cited

U.S. PATENT DOCUMENTS 9,926,808 B2 3/2018 Hallam
10,132,243 B2 11/2018 Jorgensen
(Continued)

FOREIGN PATENT DOCUMENTS

CN 201863020 U 6/2011
CN 109249231 A * 1/2019 ..... F01D 21/003
(Continued)

OTHER PUBLICATIONS

Lincoln Electric. Welding Positioners: Mechanized Automation, retreived on Dec. 12, 2022 from https://www.lincolnelectric.com/assets/global/Products/AD2403-4/e10430.pdf. (Year: 2015).*
(Continued)

*Primary Examiner* — Topaz L. Elliott
(74) *Attorney, Agent, or Firm* — Getz Balich LLC

(57) ABSTRACT

A fixture assembly includes a support stand, a support platform and a platform adaptor. The support platform is rotatably coupled to the support stand and rotatable about an axis. The support platform extends circumferentially about a centerline angularly offset from the axis. The support platform extends longitudinally along the centerline to a platform top surface. The platform adaptor is disposed on the platform top surface and attached to the support platform. The platform adaptor includes a case receptacle formed by an adaptor top surface and an adaptor shoulder surface. The platform adaptor extends longitudinally along the centerline to the adaptor top surface where the adaptor top surface is configured to longitudinally engage and support the case. The platform adaptor extends radially relative to the centerline to the adaptor shoulder surface where the adaptor shoulder surface is configured to radially engage and position the case on the adaptor top surface.

18 Claims, 11 Drawing Sheets

(56) References Cited

U.S. PATENT DOCUMENTS

| | | | | |
|---|---|---|---|---|
| 2012/0032053 | A1* | 2/2012 | Marshall | B23Q 3/062 264/275 |
| 2012/0133103 | A1* | 5/2012 | Marshall | B25B 5/065 279/2.08 |
| 2015/0283660 | A1* | 10/2015 | Cassidy | B23Q 3/06 269/304 |
| 2019/0076968 | A1* | 3/2019 | Inoue | B23K 37/0461 |
| 2020/0255270 | A1* | 8/2020 | Cerovsky | F01D 25/285 |
| 2022/0014078 | A1* | 1/2022 | Peschina | B23K 37/047 |

FOREIGN PATENT DOCUMENTS

| | | | | |
|---|---|---|---|---|
| DE | 20023688 | U1 | 8/2005 | |
| EP | 3895839 | A1 * | 10/2021 | |
| FR | 3081549 | A1 * | 11/2019 | F01D 21/003 |
| FR | 3082187 | B1 * | 8/2020 | B64F 5/50 |
| WO | WO-2016124282 | A1 * | 8/2016 | B64F 5/50 |

OTHER PUBLICATIONS

EP Search Report for EP 22217183 dated Jun. 12, 2023 (Year: 2023).*

EP Search Opinion for EP 22217183 dated Jun. 12, 2023 (Year: 2023).*

Collins English Dictionary. shoulder (mechanical engineering). Retrieved from https://www.collinsdictionary.com/US/dictionary/english/shoulder on Jul. 14, 2023. (Year: 2023).*

EP search report for EP22217183.7 dated Jun. 12, 2023.

* cited by examiner

GAS TURBINE ENGINE CASE FIXTURE ASSEMBLY WITH PLATFORM ADAPTOR

TECHNICAL FIELD

This disclosure relates generally to a gas turbine engine and, more particularly, to a fixture assembly for holding a case of the gas turbine engine.

BACKGROUND INFORMATION

A fixture assembly may be used to hold a case of a gas turbine engine during gas turbine engine assembly and/or maintenance. Various types and configurations of fixture assemblies are known in the art. While these known fixture assemblies have various benefits, there is still room in the art for improvement. There is a need in the art therefore for an improved fixture assembly for holding a gas turbine engine case.

SUMMARY

According to an aspect of the present disclosure, a fixture assembly is provided for holding a case of a gas turbine engine. This fixture assembly includes a support stand, a support platform and a platform adaptor. The support platform is rotatably coupled to the support stand and is rotatable about an axis. The support platform extends circumferentially about a centerline that is angularly offset from the axis. The support platform extends longitudinally along the centerline to a platform top surface. The platform adaptor is disposed on the platform top surface and is attached to the support platform. The platform adaptor includes a case receptacle formed by an adaptor top surface and an adaptor shoulder surface. The platform adaptor extends longitudinally along the centerline to the adaptor top surface where the adaptor top surface is configured to longitudinally engage and support the case. The platform adaptor extends radially relative to the centerline to the adaptor shoulder surface where the adaptor shoulder surface is configured to radially engage and position the case on the adaptor top surface. The adaptor top surface and the adaptor shoulder surface each extend circumferentially about the centerline.

According to another aspect of the present disclosure, a fixture assembly is provided for use while working on a first case of a first gas turbine engine and a second case of a second gas turbine engine, where the first case has a different configuration than the second case. This fixture assembly includes a support platform, a first platform adaptor and a second platform adaptor. The support platform is configured to rotate about an axis. The support platform extends longitudinally along a centerline to a platform top surface. The platform top surface extends circumferentially about the centerline. The first platform adaptor is disposable on the platform top surface and is attachable to the support platform. The first platform adaptor includes a first case receptacle formed by a first adaptor top surface and a first adaptor shoulder surface. The first adaptor top surface is configured to longitudinally engage and support the first case. The first adaptor shoulder surface is configured to radially, relative to the centerline, engage and position the first case on the first adaptor top surface within the first case receptacle. The second platform adaptor is disposable on the platform top surface and is attachable to the support platform. The second platform adaptor includes a second case receptacle formed by a second adaptor top surface and a second adaptor shoulder surface. The second adaptor top surface is configured to longitudinally engage and support the second case. The second adaptor shoulder surface is configured to radially, relative to the centerline, engage and position the second case on the second adaptor top surface within the second case receptacle.

According to still another aspect of the present disclosure, a method is provided involving a case for a gas turbine engine. During this method, a first platform adaptor is selected from a set of platform adaptors based on the configuration of the case. The first platform adaptor is disposed on a platform top surface of a support platform. The support platform extends circumferentially about a centerline. The support platform extends longitudinally along the centerline to the platform top surface. The first platform adaptor is rotated about the centerline to attach the first platform adaptor to the support platform. The case is arranged with the first platform adaptor. The case is abutted against and longitudinally supported by an adaptor top surface of the first platform adaptor. The case is abutted against and positioned on the adaptor top surface by an adaptor shoulder surface.

The method may also include attaching the case to the support platform and the first platform adaptor using a fastener. The fastener may be mated with fastener apertures in the support platform, the first platform adaptor and the case.

The platform adaptor may extend radially outwards away from the centerline to the adaptor shoulder surface.

The platform adaptor may extend radially inwards towards the centerline to the adaptor shoulder surface.

The fixture assembly may also include a fastener configured to project sequentially longitudinally through a platform fastener aperture in the support platform and an adaptor fastener aperture in the platform adaptor and into a case fastener aperture in the case to mount the case to the fixture assembly.

The support platform may include a platform fastener aperture. The platform adaptor may include an adaptor fastener aperture and an aperture indicator. The adaptor fastener aperture may be configured to align with the platform fastener aperture. The aperture indicator may be located along an outer periphery of the platform adaptor. The aperture indicator may be configured to mark a position of the adaptor fastener aperture.

The aperture indicator may include a groove that projects radially relative to the centerline into a rim of the support platform.

The platform adaptor may include a plurality of keyhole slots arranged circumferentially about the centerline. The support platform may include a plurality of protrusions. The protrusions may be configured to respectively pass through the keyhole slots when the platform adaptor is at a first position about the centerline. The protrusions may be configured to longitudinally attach the platform adaptor to the support platform when the platform adaptor is at a second position about the centerline.

The fixture assembly may also include a lock element. The lock element may be configured to mated with and may extend longitudinally within a platform lock aperture in the support platform and an adaptor lock aperture in the platform adaptor when the platform adaptor is at the second position about the centerline. The platform lock aperture may be misaligned with the adaptor lock aperture when the platform adaptor is at the first position about the centerline.

The platform adaptor may include an adaptor ring and an adaptor rim. The adaptor ring may include the adaptor top surface. The adaptor rim may project longitudinally out from the adaptor ring and may include the adaptor shoulder surface.

The support platform may be configured from or otherwise include a metal. The platform adaptor may be configured from or otherwise include a polymer.

The support stand may be configured as or otherwise include a cart.

The support stand may include a first support arm and a second support arm. The support platform may be laterally between and rotatably coupled to the first support arm and the second support arm.

The fixture assembly may also include a first mount and a second mount. The first mount may be rotatably coupled to the first support arm by a first pivot connection. The second mount may be rotatably coupled to the second support arm by a second pivot connection. The second pivot connection and the first pivot connection may be coaxial along the axis. The support platform may be laterally between and connected to the first mount and the second mount.

The support stand may include a locking device configured to rotatably lock a position of the support platform about the axis.

The support stand may include a gearbox configured to control a position of the support platform about the axis.

The support platform may include a first platform arm, a second platform arm and a platform ring laterally between the first platform arm and the second platform arm. The platform ring may include the platform top surface. The first platform arm may project out from the platform ring and may be rotatably coupled to the support stand by a first pivot connection. The second platform arm may project out from the platform ring and may be rotatably coupled to the support stand by a second pivot connection.

The support platform may include an adaptor receptacle formed by the platform top surface and a platform shoulder surface. The platform top surface may be configured to longitudinally engage and support the platform adaptor. The support platform may extend radially relative to the centerline to the platform shoulder surface where the platform shoulder surface is configured to radially engage and position the platform adaptor on the platform top surface. The platform top surface and the platform shoulder surface may each extend circumferentially about the centerline.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
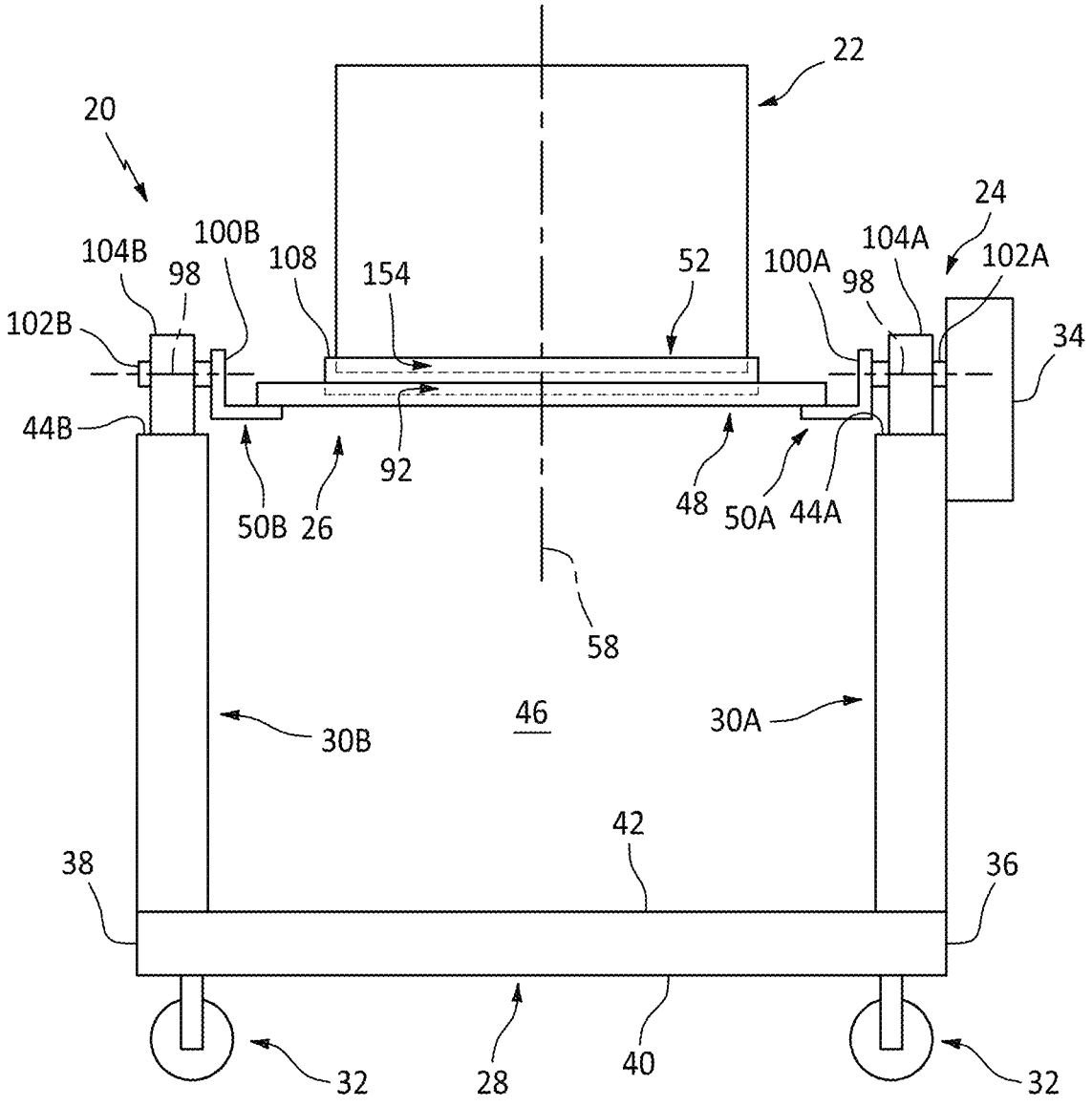
FIG. 1 is a schematic illustration of an engine case arranged with a fixture assembly.

FIG. 1 illustrates a fixture assembly 20 for holding a case 22 of a gas turbine engine. Examples of the engine case 22 include, but are not limited to, a case for a fan section of a gas turbine engine, a case for a compressor section of a gas turbine engine, a case for a combustor section of a gas turbine engine, a case for a turbine section of a gas turbine engine, a case for an exhaust section of a gas turbine engine, or any other housing structure of a gas turbine engine. The fixture assembly 20 may hold the engine case 22 during gas turbine engine assembly, during gas turbine engine maintenance or otherwise. The fixture assembly 20 of FIG. 1 includes a support stand 24 and a carrier structure 26.

The support stand 24 is configured as a base support structure for the fixture assembly 20. The support stand 24 of FIG. 1, for example, is configured as a support cradle that selectively movably (e.g., rotatably) supports the carrier structure 26. The support stand 24 of FIG. 1 is configured as a movable support stand; e.g., a wheeled cart. The support stand 24 of FIG. 1, for example, includes a support stand base 28, one or more support arms 30A and 30B (generally referred to as "30") and one or more wheel assemblies 32; e.g., fixed and/or moveable casters. The support stand 24 of FIG. 1 also includes carrier structure movement control device 34.

The stand base 28 extends laterally between and to a first end 36 of the stand base 28 and a second end 38 of the stand base 28. The stand base 28 extends vertically (e.g., up or down relative to gravity) between and to a bottom side 40 of the stand base 28 and a top side 42 of the stand base 28.

The first support arm 30A is attached (e.g., mechanically fastened, bonded, etc.) to the stand base 28 at (e.g., on, adjacent or proximate) the base first end 36. The first support arm 30A may be configured as a pedestal, a wall or another vertically extending structure. The first support arm 30A of FIG. 1, for example, projects vertically out from the stand base 28 at its base top side 42 to a vertical distal end 44A of the first support arm 30A.

The second support arm 30B is attached to the stand base 28 at the base second end 38. The second support arm 30B may be configured as a pedestal, a wall or another vertically extending structure. The second support arm 30B of FIG. 1, for example, projects vertically out from the stand base 28 at its base top side 42 to a vertical distal end 44B of the second support arm 30B.

The second support arm 30B is laterally separated from the first support arm 30A by an open volume 46; e.g., a channel. This open volume 46 extends laterally within the support stand 24 between and its peripheral sides are formed by the first support arm 30A and the second support arm 30B. The open volume 46 projects vertically into the support stand 24 from a vertical top of the support stand 24 at the support arm distal end 44A and 44B to the base top side 42, which base top side 42 forms a peripheral bottom end of the open volume 46. The open volume 46 extends transversely (e.g., in or out of a plane of FIG. 1) through or within the support stand 24.

The wheel assemblies 32 are arranged at a bottom of the support stand 24. Each of these wheel assemblies 32, for example, is attached to the stand base 28 and project vertically out from the base bottom side 40. The wheel assemblies 32 of FIG. 1 may be arranged respectively at four outside corners of the support stand 24.

The movement control device 34 is configured to selectively actuate or prevent movement (e.g., rotation) of the carrier structure 26. The movement control device 34, for example, may be configured as a gearbox. The movement control device 34 of FIG. 1 is attached to the first support arm 30A at the first support arm distal end 44A. The movement control device 34 of FIG. 1 is arranged at a first end of the support stand 24, for example, outside of the open volume 46.

The carrier structure 26 of FIG. 1 includes a support platform 48 and one or more platform mounts 50A and 50B (generally referred to as "50"). This carrier structure 26 also includes a platform adaptor 52 configured to adapt the support platform 48 to hold the engine case 22.

Figure 2:
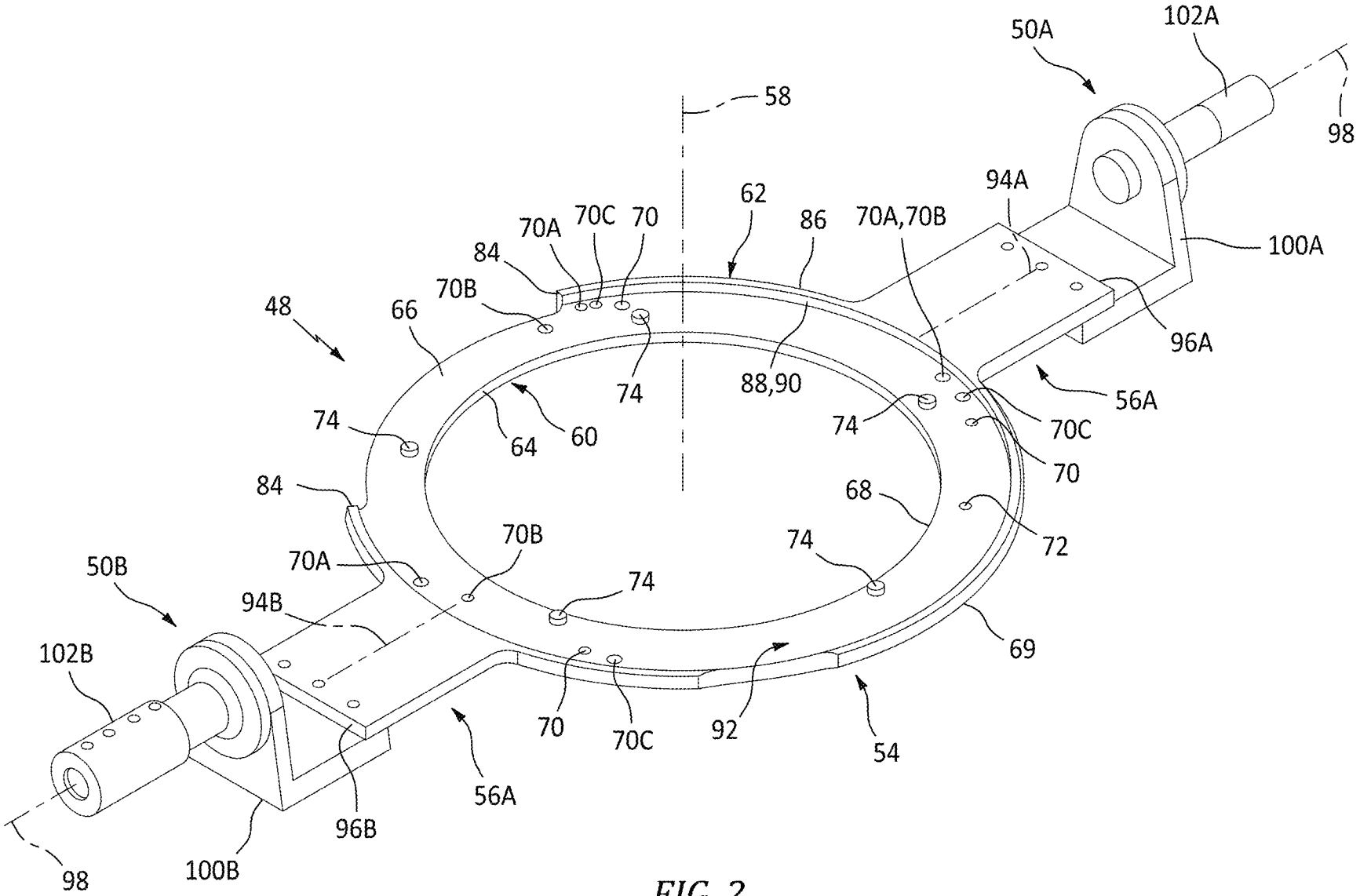
FIG. 2 is a perspective illustration of a support platform configured with a plurality of platform mounts.

The support platform 48 FIG. 2 includes a platform ring 54 and one or more platform arms 56A and 56B (generally referred to as "56"); e.g., tabs, flanges, etc. The platform ring 54 extends circumferentially about (e.g., completely around) a longitudinal centerline 58, which may thereby provide the platform ring 54 with a full-hoop annular body. The longitudinal centerline 58 may also be (or may be parallel with) a centerline of the engine case 22; see FIG. 1. The platform ring 54 of FIG. 2 includes a platform ring base 60 ("platform base") and a platform ring rim 62 ("platform rim").

The platform base 60 extends circumferentially about (e.g., completely around) the longitudinal centerline 58. The platform base 60 extends longitudinally along the longitudinal centerline 58 between and to a bottom surface 64 of the support platform 48 and its platform base 60 and a top surface 66 of the support platform 48 and its platform base 60. The platform base 60 extends radially (relative to the longitudinal centerline 58) between and to a radial inner side 68 of the platform ring 54 and its platform base 60 and a radial outer side 69 of the platform ring 54 and its platform base 60.

The platform base 60 of FIG. 2 is configured with one or more platform fastener apertures 70A, 70B and 70C (generally referred to as "70") and at least one platform lock aperture 72. This platform base 60 also includes one or more mounting protrusions 74.

The platform fastener apertures 70 are configured into one or more sets of platform fastener apertures 70A, 70B, 70C. The platform fastener apertures 70 in each set are arranged circumferentially about the longitudinal centerline 58 in a pattern. The pattern for each platform fastener aperture set may correspond to a pattern of select fastener apertures (e.g., a subgrouping of available fastener apertures) in the engine case 22 to be held by the fixture assembly 20. For example, the pattern for the first platform fastener aperture set (e.g., 70A) may match the pattern of select fastener apertures in a first engine case having a first engine case configuration (e.g., size, geometry, features, etc.). The pattern for the second platform fastener aperture set (e.g., 70B) may match the pattern of select fastener apertures in a second engine case having a second engine case configuration that is different than the first engine case configuration. The single support platform 48 may thereby be configured to separately (e.g., one at a time) hold several different engine cases 22. Each of the platform fastener apertures 70 extends longitudinally through the support platform 48 and its platform base 60 between the platform bottom surface 64 and the platform top surface 66. One or more or all of these platform fastener apertures 70 may each be configured as a threaded (e.g., tapped) aperture.

Figure 3:
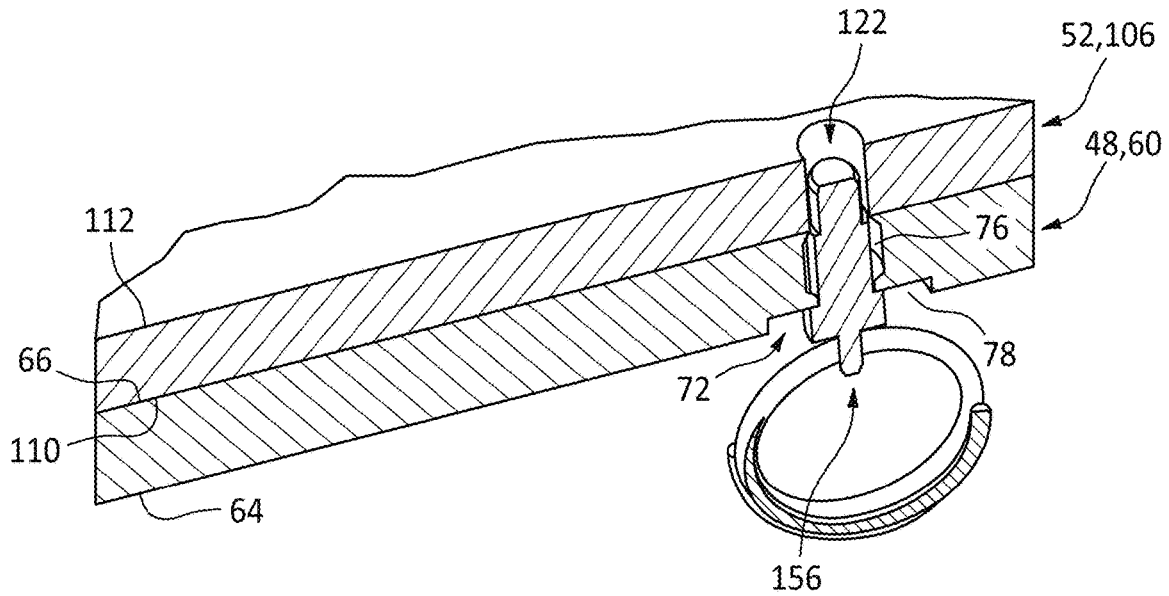
FIG. 3 is a perspective sectional illustration of a lock element mated with the support platform and a platform adaptor.

The platform lock aperture 72 extends longitudinally through the support platform 48 and its platform base 60 between the platform bottom surface 64 and the platform top surface 66. Referring to FIG. 3, the platform lock aperture 72 may include a bore 76 and a counter bore 78. The bore 76 may be a threaded portion of the platform lock aperture 72 which projects longitudinally into the support platform 48 and its platform base 60 from the platform top surface 66 to the counterbore 78. The counterbore 78 may be an unthreaded portion of the platform lock aperture 72 which projects longitudinally into the support platform 48 and its platform base 60 from the platform bottom surface 64 to the bore 76. Of course, in other embodiments, an entirety of the platform lock aperture 72 may be threaded or unthreaded.

Figure 4A:
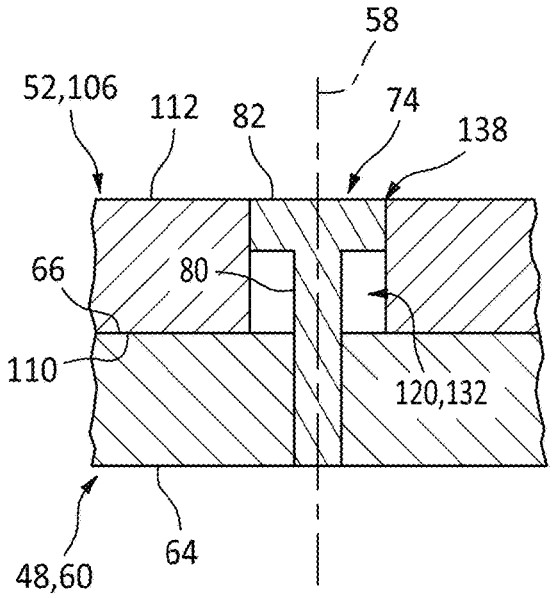
FIG. 4A is a sectional illustration of a mounting protrusion mated with a keyhole slot in an unlocked position.
Figure 4B:
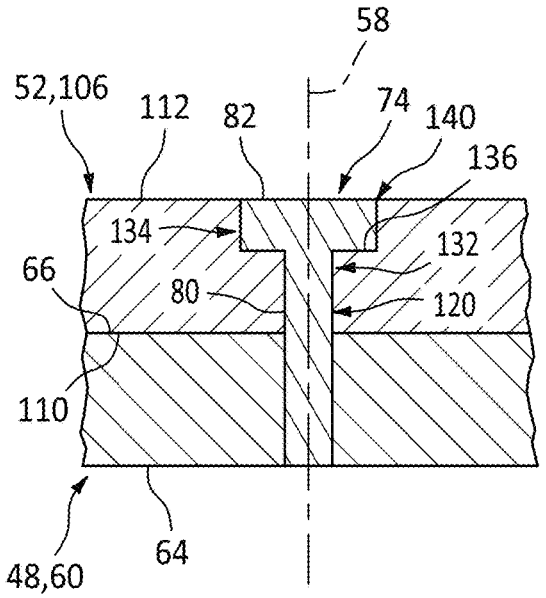
FIG. 4B is a sectional illustration of the mounting protrusion mated with the keyhole slot in a locked position.

Referring to FIG. 2, the mounting protrusions 74 are arranged circumferentially about the longitudinal centerline 58 in an array. Referring to FIGS. 4A and 4B, each of the mounting protrusions 74 is connected to (e.g., threaded into or otherwise attached to) the platform base 60. Each of the mounting protrusions 74 includes a post 80 (e.g., an unthreaded portion of a fastener shank) and a head 82. The post 80 projects longitudinally out from the platform base 60 and is platform top surface 66 to the head 82. The head 82 is connected (e.g., formed integral with) to the post 80, and disposed at a top longitudinal distal end of the respective mounting protrusion 74. A size (e.g., a width, a diameter) of the head 82 is greater than a size (e.g., a width, a diameter) of the respective post 80. Each of the mounting protrusions 74 (at least outside of the platform base 60) may thereby have a T-shaped sectional geometry when viewed, for example, in a plane parallel with the longitudinal centerline 58; e.g., the plane of FIGS. 4A and 4B.

Referring to FIG. 2, the platform rim 62 is connected to (e.g., formed integral with) the platform base 60 at the platform top surface 66. This platform rim 62 extends circumferentially about (e.g., partially around) the longitudinal centerline 58. The platform rim 62 of FIG. 2, for example, extends between two-hundred and seventy degrees (270°) and three-hundred and fifty degrees (350°) around the longitudinal centerline 58 between circumferentially opposite ends 84 of the platform rim 62. Of course, in other embodiments, the platform rim 62 may extend less than two-hundred and seventy degrees (270°) around the longitudinal centerline 58, or more than three-hundred and fifty degrees (350°) around the longitudinal centerline 58; e.g., completely around the longitudinal centerline 58. The platform rim 62 of FIG. 2 projects longitudinally out from the platform base 60 and its platform top surface 66 to a longitudinally top distal end 86 of the platform rim 62. The platform rim 62 extends radially (relative to the longitudinal centerline 58) between and to an inner side 88 of the platform rim 62 and the platform ring outer side 69, where a (e.g., arcuate) shoulder surface 90 of the platform rim 62 at the rim inner side 88 may be adjacent and contiguous with the platform top surface 66.

With the foregoing configuration, the support platform 48 and its platform rim 62 are provided with an adaptor receptacle 92. This adaptor receptacle 92 is formed at least by the platform top surface 66 and the platform shoulder surface 90. More particularly, the adaptor receptacle 92 projects longitudinally along the longitudinal centerline 58 into the support platform 48 and its platform ring 54 to the platform top surface 66. The adaptor receptacle 92 extends within the support platform 48 and its platform ring 54 radially (relative to the longitudinal centerline 58) outward from the longitudinal centerline 58 to the platform shoulder surface 90.

The platform arms 56 may be arranged circumferentially about the longitudinal centerline 58 on opposing lateral sides of the platform ring 54. The platform arms 56 of FIG. 2, for example, are disposed on diametrically opposed sides of the platform ring 54. Each of the platform arms 56A, 56B is connected to (e.g., formed integral with) the platform ring 54. Each of the platform arms 56A, 56B projects radially (relative to the longitudinal centerline 58) out from the platform ring 54 along a (e.g., radially extending) centerline 94A, 94B of the respective platform arm 56A, 56B to a radial outer distal end 96A, 96B of the respective platform arm 56A, 56B. The arm centerlines 94A and 94B of the platform arms 56A and 56B may be parallel (e.g., coaxial) with one another. These arm centerlines 94A and 94B may also be parallel with (e.g., but, longitudinally offset downward from) a rotational axis 98 of the carrier structure 26, which rotational axis 98 is angularly offset from (e.g., perpendicular to) and may be coincident with the longitudinal centerline 58. Each of the platform arms 56A, 56B extends longitudinally along the longitudinal centerline 58 between and to a bottom side of the support platform 48 and its respective platform arm 56A, 56B and a top side of the support platform 48 and its respective platform arm 56A, 56B.

Each of the platform mounts 50A, 50B is arranged with a respective one of the platform arms 56A, 56B at its distal end 96A, 96B. Each of the platform mounts 50 of FIG. 2 includes a bracket 100A, 100B (generally referred to as "100") and a shaft 102A, 102B (generally referred to as "102"). The bracket 100A, 100B is attached (e.g., mechanically fastened) to the respective platform arm 56A, 56B. The shaft 102 is connected to (e.g., mechanically fastened, formed integral with, etc.) the bracket 100. The shaft 102 projects axially along the rotational axis 98 out from the bracket 100 to an outer distal end of the shaft 102.

The carrier structure components 48, 50A and 50B may each be constructed from a structurally stiff and strong material. The carrier structure components 48, 50A and 50B, for example, may each be constructed from a metal such as, but not limited to, steel.

Referring to FIG. 1, each of the platform mounts 50 is mated with a respective mount 104A, 104B on a respective one of the support arms 30A, 30B. The shaft 102A of the first platform mount 50A, for example, projects axially along the rotational axis 98 into (or through) the first support arm mount 104A, and the first support arm mount 104A rotatably supports the shaft 102A with the first support arm 30A. This shaft 102A may also be motively coupled to the movement control device 34; e.g., the gearbox. The shaft 102B of the second platform mount 50B projects axially along the rotational axis 98 into (or through) the second support arm mount 104B, and the second support arm mount 104B rotatably supports the shaft 102B with the second support arm 30B. With this configuration, the carrier structure 26 is operable to rotate about the rotational axis 98; however, a rotational position of the carrier structure 26 may be selectively held (e.g., locked) using the movement control device 34 (e.g., the gearbox) or another rotational lock device.

Figure 5A:
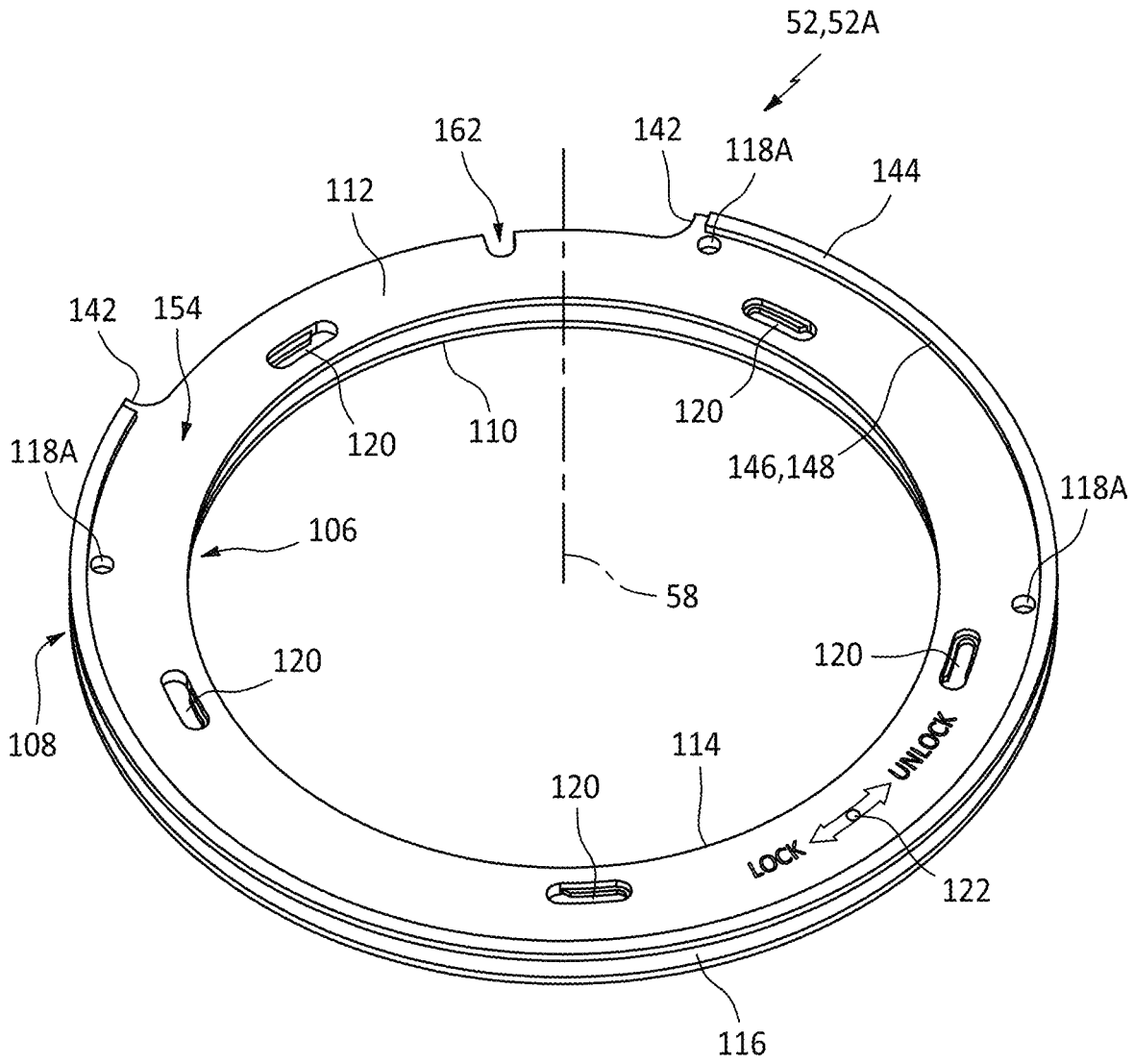
FIGS. 5A and 5B are perspective illustrations of various platform adaptors configured with different patterns of fastener apertures and outside rim configurations.
Figure 5B:
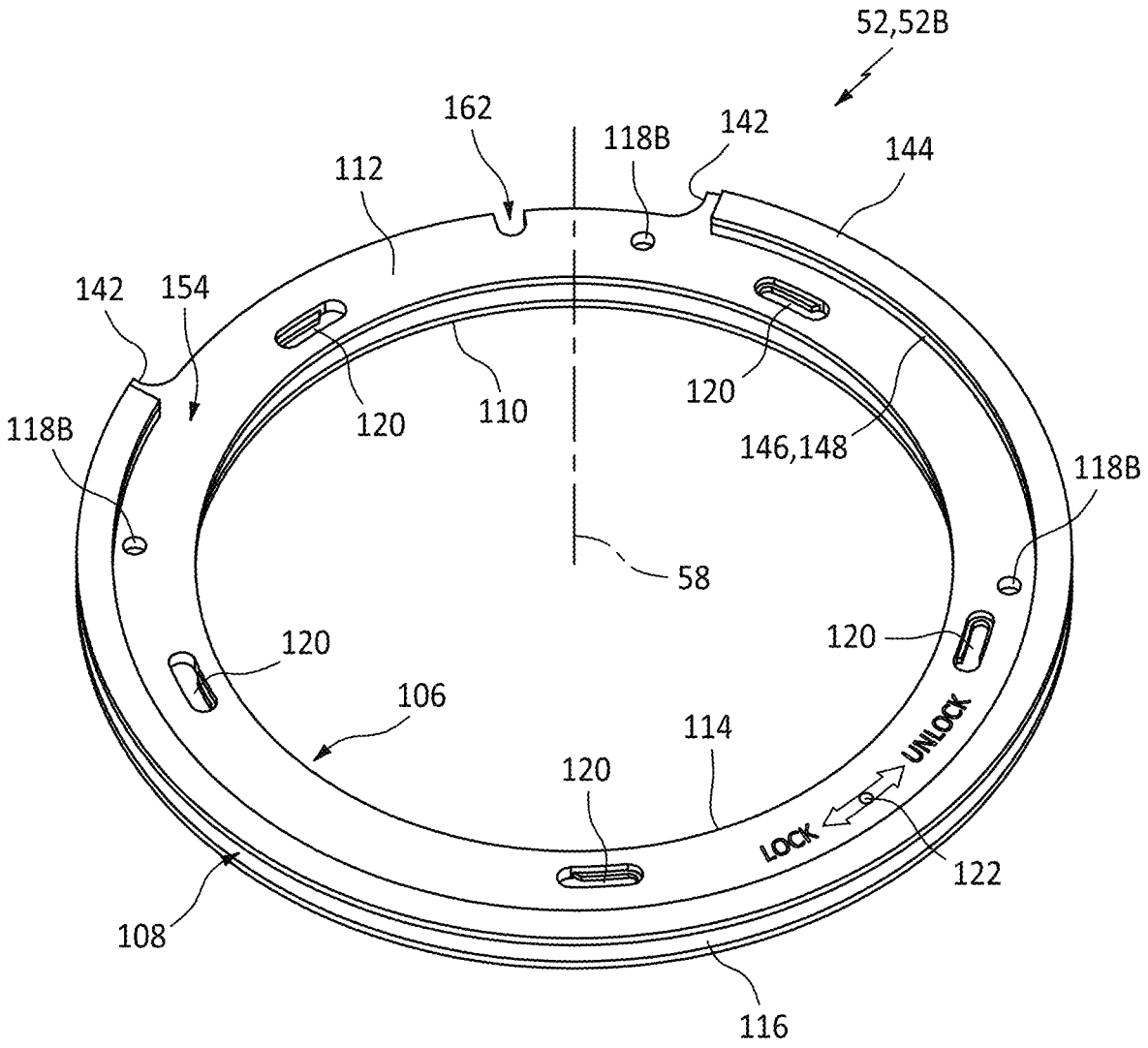

FIGS. 5A and 5B illustrate various different platform adaptors 52A and 52B (generally referred to as "52") which may be used with the fixture assembly 20 (see FIG. 1). Each of these platform adaptors 52 is configured to adapt the carrier structure 26 to receive, mate with and hold a different engine case 22 (see FIG. 1). Each platform adaptor 52 of FIGS. 5A and 5B extends circumferentially about (e.g., completely around) the longitudinal centerline 58, which may thereby provide that respective platform adaptor 52 with a full-hoop annular body. Each platform adaptor 52 of FIGS. 5A and 5B includes an adaptor base 106 (e.g., an adaptor ring) and an adaptor rim 108.

The adaptor base 106 extends circumferentially about (e.g., completely around) the longitudinal centerline 58. The adaptor base 106 extends longitudinally along the longitudinal centerline 58 between and to a bottom surface 110 of the platform adaptor 52 and its adaptor base 106 and a top surface 112 of the platform adaptor 52 and its adaptor base 106. The platform base 60 extends radially (relative to the longitudinal centerline 58) between and to a radial inner side 114 of the platform adaptor 52 and its adaptor base 106 and a radial outer side 116 of the platform adaptor 52 and its adaptor base 106. The adaptor base 106 of FIGS. 5A and 5B is configured with one or more adaptor fastener apertures 118A, 118B (generally referred to as "118"), one or more keyhole slots 120 and at least one adaptor lock aperture 122.

The adaptor fastener apertures 118 are arranged circumferentially about the longitudinal centerline 58 in a pattern. This pattern of the adaptor fastener apertures 118 is configured to match the pattern of the platform fastener apertures 70 in one of its sets; see FIG. 2. The pattern of the adaptor fastener apertures 118 for each platform adaptor 52 may thereby match the pattern of the case fastener apertures for one specific engine case configuration. For example, the pattern of the adaptor fastener apertures 118A in the platform adaptor 52A of FIG. 5A may match the pattern of select fastener apertures in the first engine case having the first engine case configuration as well as a corresponding set of the platform fastener apertures 70A (see FIG. 2) in the support platform 48. The pattern of the adaptor fastener apertures 118B in the platform adaptor 52B of FIG. 5B may match the pattern of select fastener apertures in the second engine case having the second engine case configuration as well as a corresponding set of the platform fastener apertures 70B (see FIG. 2) in the support platform 48. Each of the adaptor fastener apertures 118 of FIGS. 5A and 5B extends longitudinally through the platform adaptor 52 and its adaptor base 106 between the adaptor bottom surface 110 and the adaptor top surface 112. One or more or all of these adaptor fastener apertures 118 may each be configured as an unthreaded aperture.

Figure 6:
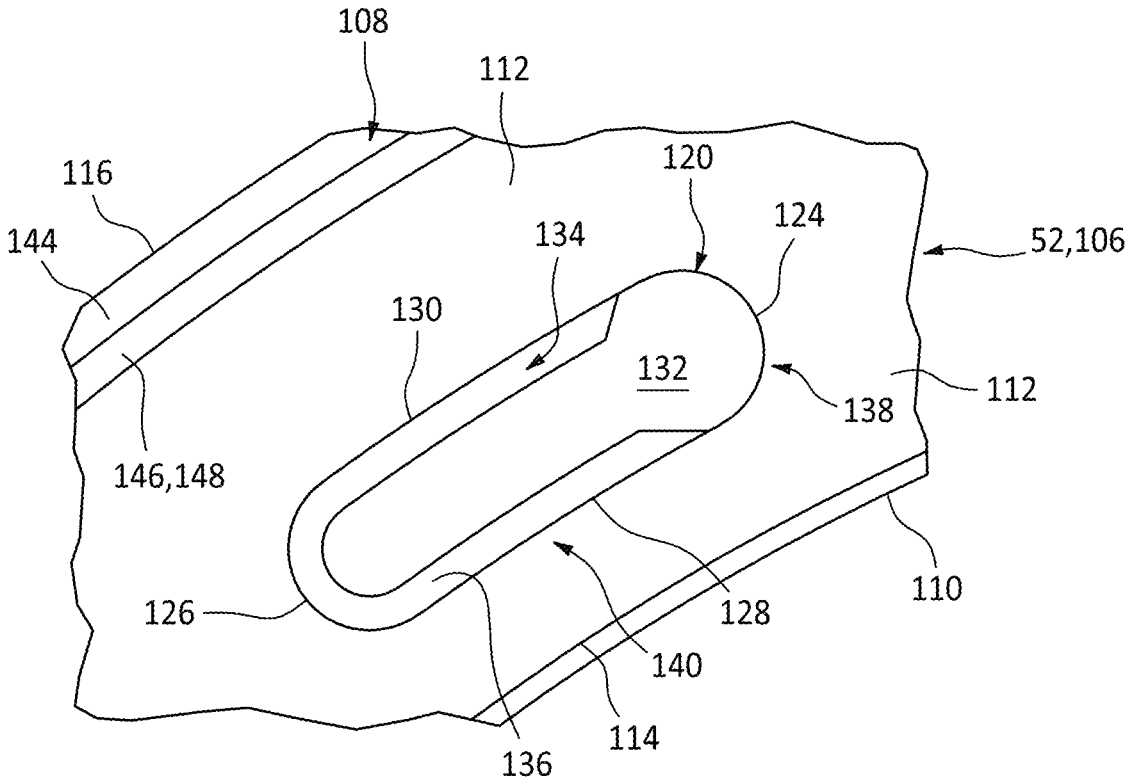
FIG. 6 is an illustration of a keyhole slot in the platform adaptor.

Referring to FIGS. 5A and 5B, the keyhole slots 120 are arranged circumferentially about the longitudinal centerline 58 in an array. Referring to FIG. 6, each of the keyhole slots 120 extends circumferentially about the longitudinal centerline 58 (see FIGS. 5A and 5B) between and to a first end 124 of the respective keyhole slot 120 and a second end 126 of the respective keyhole slot 120. Each of the keyhole slots 120 extends radially (relative to the longitudinal centerline 58) between and to a radial inner side 128 of the respective keyhole slot 120 and a radial outer side 130 of the respective keyhole slot 120. Each of the keyhole slots 120 includes a through aperture 132 and a notch 134. The through aperture 132 extends longitudinally through the platform adaptor 52 and its adaptor base 106 between the adaptor bottom surface 110 and the adaptor top surface 112. The notch 134 projects longitudinally into the platform adaptor 52 and its adaptor base 106 from the adaptor top surface 112 to a bottom shoulder surface 136 of the notch 134. This bottom shoulder surface 136 extends partially around a perimeter of the through aperture 132. The through aperture 132 and the notch 134 may thereby provide each keyhole slot 120 with an open region 138 and a retainer region 140. Referring to FIG. 4A, the open region 138 is configured to receive the head 82 of a respective one of the mounting protrusions 74 such that the head 82 may pass unobstructed into or through the respective keyhole slot 120 and its open region 138. Referring to FIG. 4B, the retainer region 140 is configured to retain a respective one of the mounting protrusions 74 within the keyhole slot 120 and its retainer region 140. The head 82 of the respective mounting protrusions 74, for example, longitudinally abuts against the bottom shoulder surface 136, which prevents the head 82 of the respective mounting protrusions 74 from being removed longitudinally from the respective keyhole slot 120 and its retainer region 140.

Referring to FIG. 3, the adaptor lock aperture 122 extends longitudinally through the platform adaptor 52 and its adaptor base 106 between the adaptor bottom surface 110 and the adaptor top surface 112. The adaptor lock aperture 122 may be configured as an unthreaded aperture.

Referring to FIGS. 5A and 5B, the adaptor rim 108 is connected to (e.g., formed integral with) the adaptor base 106 at the adaptor top surface 112. This adaptor rim 108 extends circumferentially about (e.g., partially around) the longitudinal centerline 58. The adaptor rim 108 of FIGS. 5A and 5B, for example, extends between two-hundred and seventy degrees (270°) and three-hundred and fifty degrees (350°) around the longitudinal centerline 58 between circumferentially opposite ends 142 of the adaptor rim 108. Of course, in other embodiments, the adaptor rim 108 may extend less than two-hundred and seventy degrees (270°) around the longitudinal centerline 58, or more than three-hundred and fifty degrees (350°) around the longitudinal centerline 58; e.g., completely around the longitudinal centerline 58. The adaptor rim 108 of FIGS. 5A and 5B projects longitudinally out from the adaptor base 106 and its adaptor top surface 112 to a longitudinally top distal end 144 of the adaptor rim 108. The adaptor rim 108 extends radially (relative to the longitudinal centerline 58) between and to an inner side 146 of the adaptor rim 108 and the adaptor outer side 116, where a (e.g., arcuate) shoulder surface 148 of the adaptor rim 108 at the rim inner side 146 may be adjacent and contiguous with the adaptor top surface 112.

Figure 7:
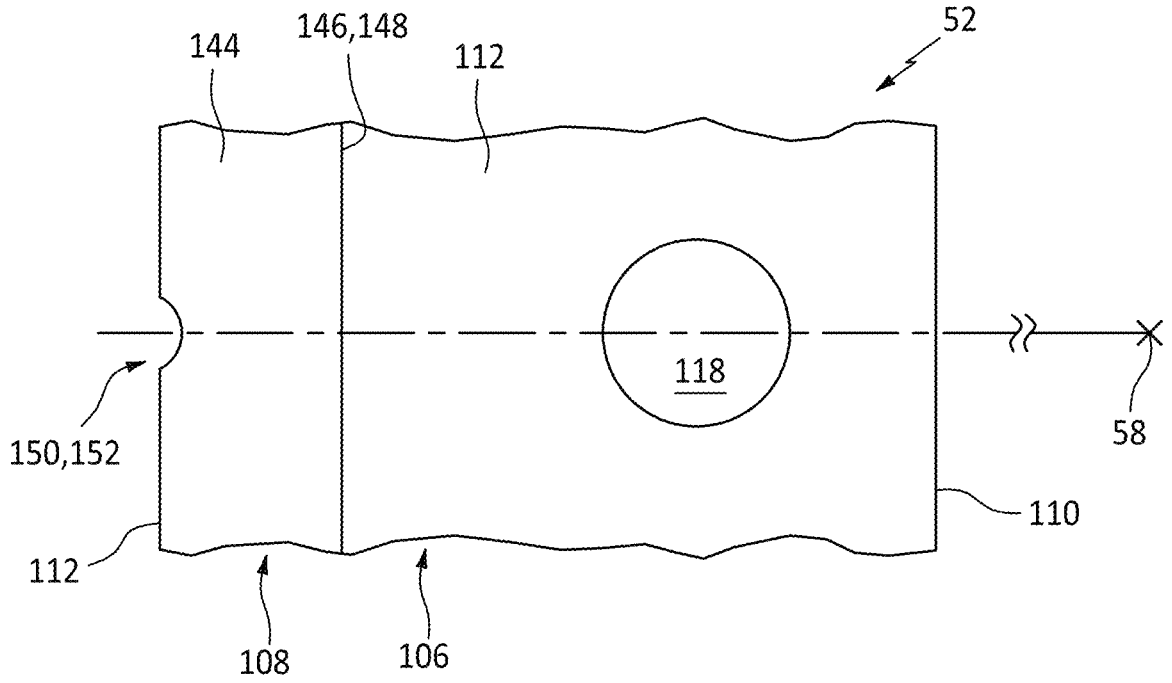
FIG. 7 is an illustration of an aperture indicator aligned with a fastener aperture in the platform adaptor.

Referring to FIG. 7, the adaptor rim 108 may be configured with an aperture indicator 150 for each of the adaptor fastener apertures 118. This aperture indicator 150 of FIG. 7 is located along an outer periphery of the platform adaptor 52 and its adaptor rim 108. The aperture indicator 150 is circumferentially aligned with a respective one of the adaptor fastener apertures 118 about the longitudinal centerline 58. The aperture indicator 150 may thereby mark a circumferential position of the respective adaptor fastener aperture 118 such that the location of the respective adaptor fastener aperture 118 may be determined even where, for example, the respective adaptor fastener aperture 118 is covered by the engine case 22 (see FIG. 1). In the embodiment of FIG. 7, the aperture indicator 150 is configured as a groove 152 that projects radially (relative to the longitudinal centerline 58) into the adaptor rim 108.

With the foregoing configuration, the platform adaptor 52 is provided with a case receptacle 154. This case receptacle 154 is formed at least by the adaptor top surface 112 and the adaptor shoulder surface 148. More particularly, the case receptacle 154 projects longitudinally along the longitudinal centerline 58 into the into the platform adaptor 52 to the adaptor top surface 112. The case receptacle 154 extends within the platform adaptor 52 radially outward from the longitudinal centerline 58 to the adaptor shoulder surface 148.

The platform adaptor 52 may be constructed as a monolithic body from a relatively soft material which is less likely (compared to metal) to mar or otherwise damage the engine case 22 when in contact with the engine case 22. The platform adaptor 52, for example, may be constructed from a polymer material such as, but not limited to, a thermoplastic material.

Figure 8A:
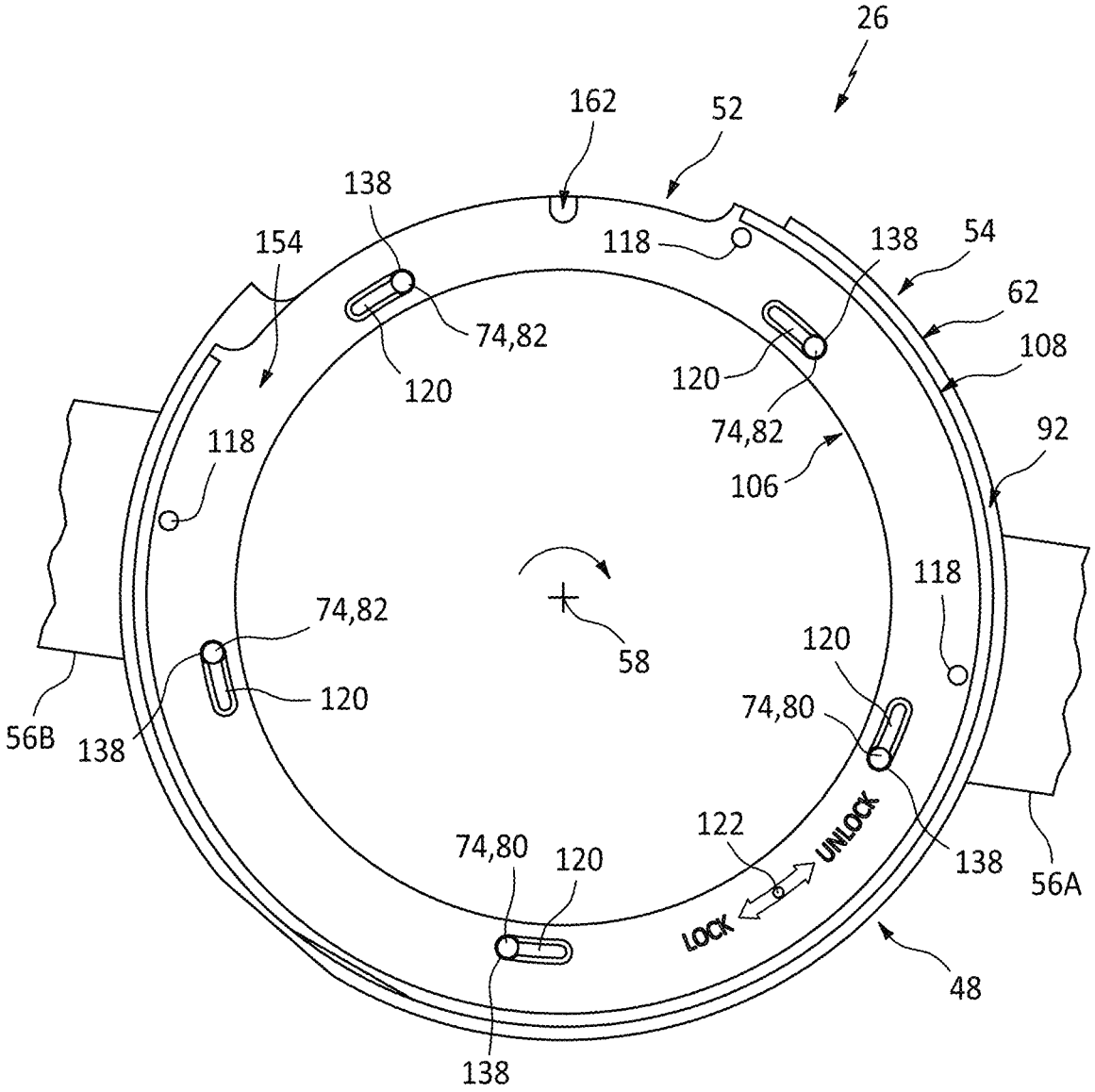
FIGS. 8A and 8B illustrate a sequence for mating the platform adaptor to the support platform.
Figure 8B:
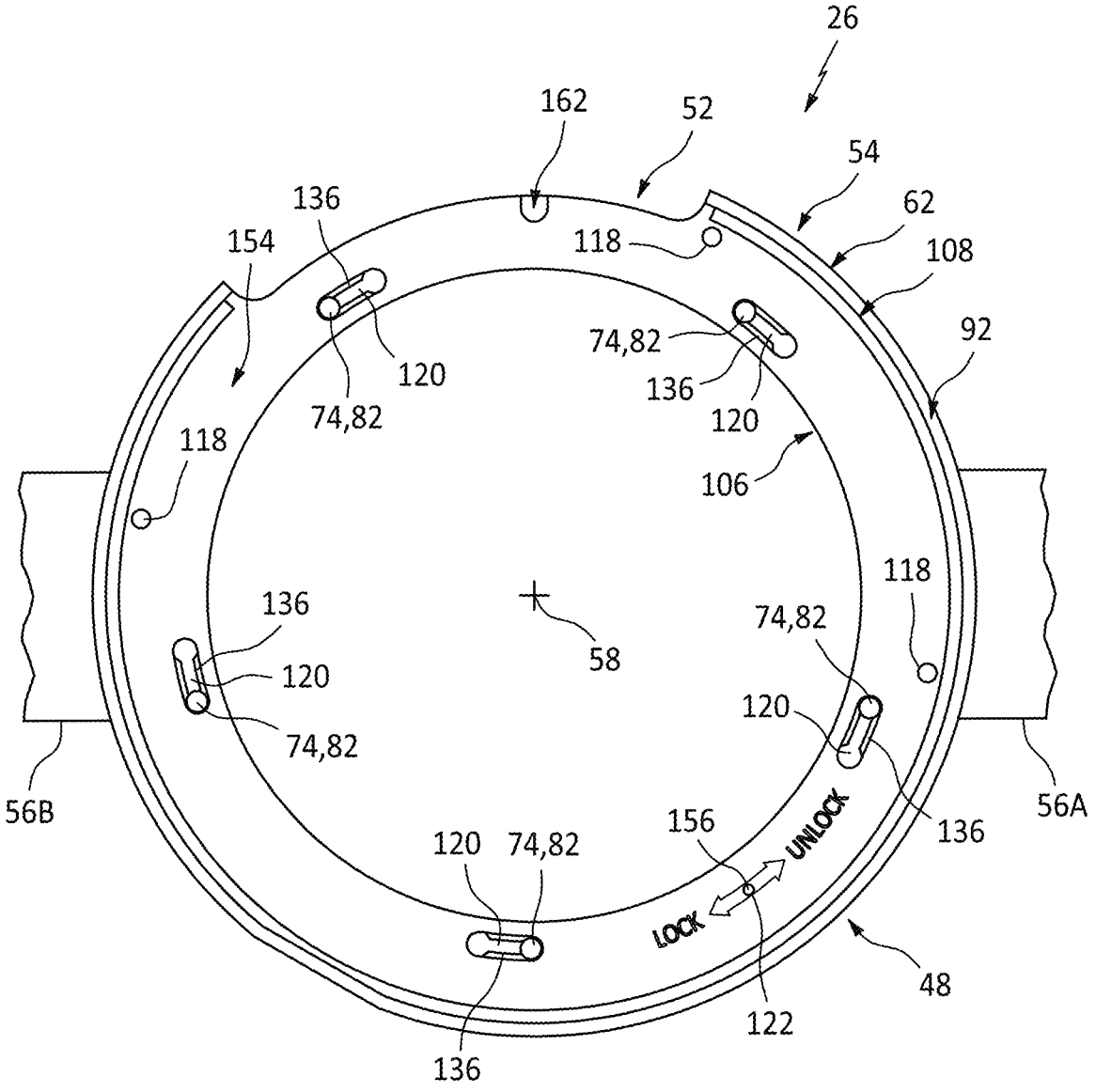

FIGS. 8A and 8B illustrate a sequence for mating the platform adaptor 52 to the support platform 48. Referring to FIG. 8A, the platform adaptor 52 is received within the adaptor receptacle 92. The platform protrusions are aligned with the open regions 138. Referring to FIG. 4A, each head 82 is inserted into (or through) a respective open region 138 until the adaptor bottom surface 110 longitudinally engages (e.g., contacts) the platform top surface 66. The platform adaptor 52 is then rotated about the longitudinal centerline 58 form the unlocked position of FIG. 8A to the locked position of FIG. 8B. In this locked position of FIG. 8B, each bottom shoulder surface 136 is overlapped by a respective one of the heads 82 such that the platform adaptor 52 is captured longitudinally between the heads 82 and the platform top surface 66; see FIG. 4B. The adaptor fastener apertures 118 are (e.g., circumferentially and radially) aligned with a respective set of the platform fastener apertures 70 (see FIG. 2). Referring to FIG. 3, the adaptor lock aperture 122 is also (e.g., circumferentially and radially) aligned with the platform lock aperture 72, and a lock element 156 (e.g., a pin with a threaded base) is mated with the adaptor lock aperture 122 and the platform lock aperture 72. The lock element 156 may thereby rotatably fix the platform adaptor 52 about the longitudinal centerline 58 in the locked position of FIG. 8B.

Figure 9:
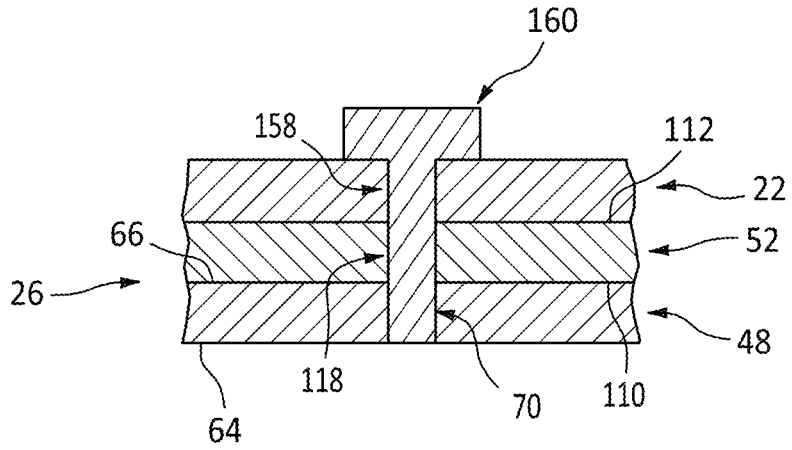
FIG. 9 is a sectional illustration of a fastener securing the engine case to the support platform and the platform adaptor.

Referring to FIG. 1, during use of the fixture assembly 20, the engine case 22 is mated with the fixture assembly 20. More particularly, the engine case 22 is received within the case receptacle 154 where the rim 108 may prevent (or reduce) the engine case 22 from sliding or otherwise shifting. Referring to FIG. 9, each set of the fastener apertures 70 and 118 is (e.g., circumferentially and radially) aligned with a respective one of the fastener apertures 158 in (e.g., a flange of) the engine case 22. A respective fastener 160 may then be mated with each set of fastener apertures 70, 118 and 158 to secure the engine case 22 to the fixture assembly 20.

Figure 10:
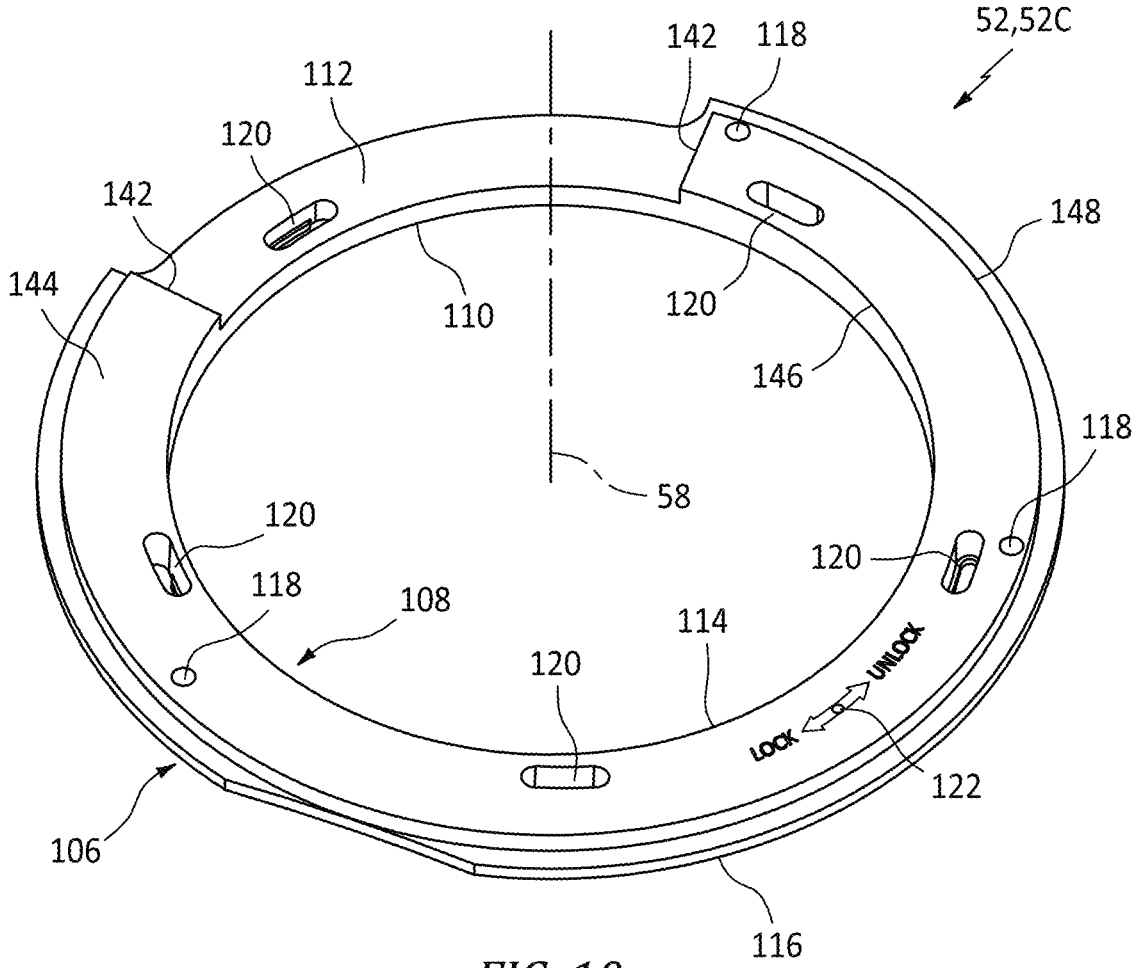
FIG. 10 is a perspective illustration of the platform adaptor with another pattern of fastener apertures and an inside rim.

In some embodiments, referring to FIGS. 5A and 5B, the platform adaptor 52A, 52B and its adaptor rim 108 extend radially inwards (towards the longitudinal centerline 58) to the adaptor shoulder surface 148; here, the rim 108 is a radial outer rim. With such an arrangement, the adaptor rim 108 may at least partially surround/circumscribe the engine case 22 (see FIG. 1). In other embodiments, referring to FIG. 10, the platform adaptor 52C (generally referred to, along with 52A and 52B, as "52") and its adaptor rim 108 extend radially outward (away from the longitudinal centerline 58) to the adaptor shoulder surface 148; here, the rim 108 is a radial inner rim. With such an arrangement, a rim of the engine case 22 (see FIG. 1) may at least partially surround/circumscribe the adaptor rim 108.

Figure 11:
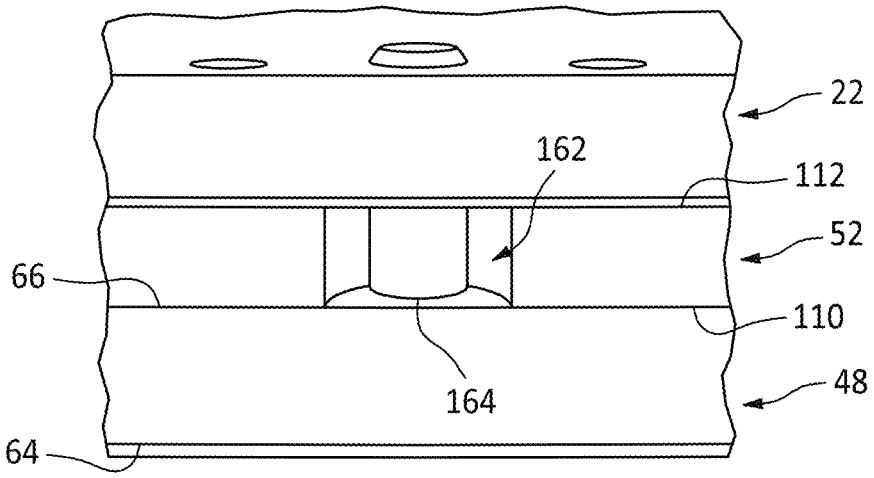
FIG. 11 is a perspective illustration of a locator mated with a locator aperture.

In some embodiments, referring to FIG. 5A, the platform adaptor 52 may be configured with a locator aperture 162; e.g., a notch or a groove. Referring to FIG. 11, this locator aperture 162 may receive a locator 164 (e.g., a pin) connected to the engine case 22. The locator aperture 162 and the locator 164 may thereby rotationally orient the engine case 22 in a known spatial orientation on the fixture assembly 20. The locator 164 of FIG. 11 may identify (e.g., be circumferentially aligned with) a top-dead-center point on the engine case 22.

The support stand 24 of FIG. 1 is described above as a movable support stand; e.g., a wheeled cart. The support stand 24 of the present disclosure, however, may alternatively be configured as a stationary support stand which may generally remain at a fixed position at a station within a facility.

Figure 12:
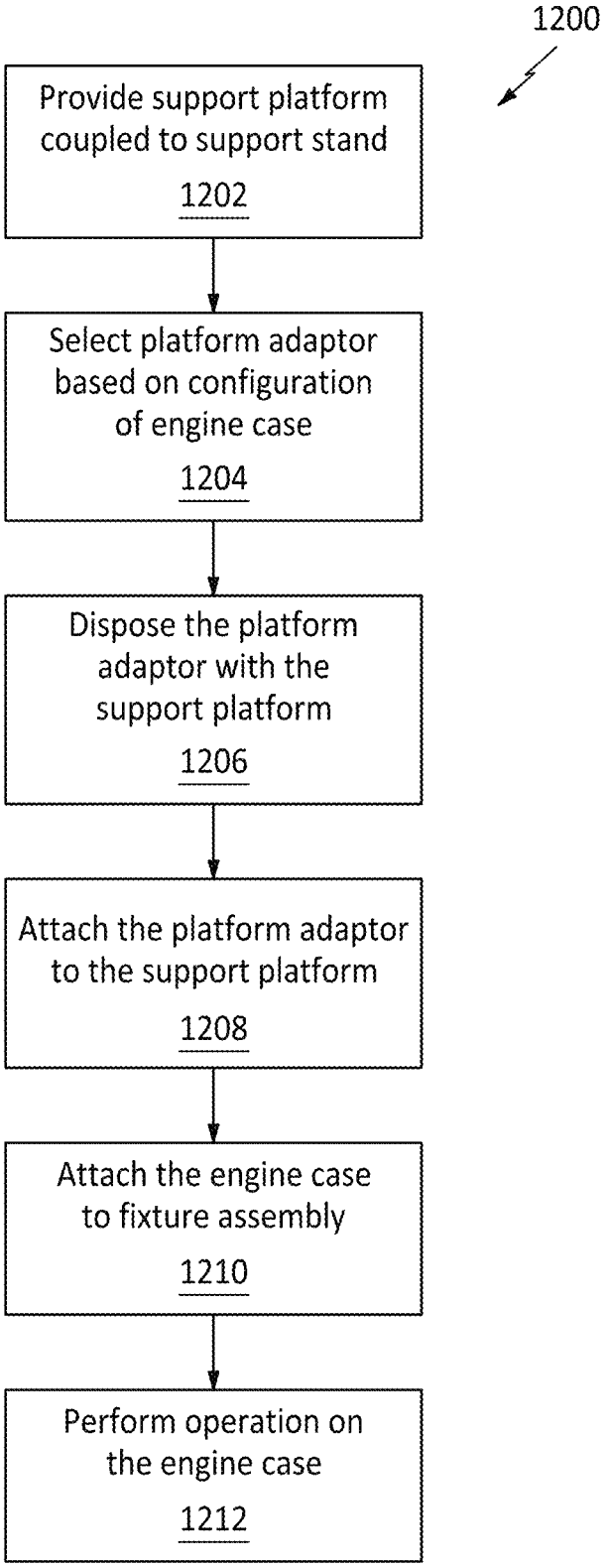
FIG. 12 is a flow diagram of a method involving an engine case and a fixture assembly for holding the engine case.

FIG. 12 is a flow diagram of a method 1200 involving the engine case 22. This method 1200 is described below with reference to the fixture assembly 20 of FIG. 1 for ease of description. The method 1200 of the present disclosure, however, may alternatively be performed using a fixture assembly having other configurations.

In step 1202, an assembly of the support platform 48 rotatably coupled with the support stand 24 is provided.

In step 1204, one of the available platform adaptors 52 is selected that matches a configuration of the engine case 22 to be held by the fixture assembly 20.

In step 1206, the (e.g., selected) platform adaptor 52 is disposed on the platform top surface 66. In this position, the mounting protrusions 74 may be mated with the keyhole slots 120 at the unlocked position.

In step 1208, the platform adaptor 52 is attached to the support platform 48. The platform adaptor 52, for example, is rotated about the longitudinal centerline 58 from the unlocked position (see FIG. 8A) to the locked position (see FIG. 8B). The lock element 156 (see FIG. 3) is also inserted into the adaptor lock aperture 122 and the platform lock aperture 72.

In step 1210, the engine case 22 is attached to the fixture assembly 20. The engine case 22, for example, is received by the case receptacle 154 and the respective fastener apertures 70, 118 and 158 are (e.g., circumferentially and/or radially) aligned. Each set of the fastener apertures 70, 118 and 158 then receives a respective one of the fasteners 160 to fix the engine case 22 to the platform adaptor 52 and the support platform 48.

In step 1212, one or more operations are performed to the engine case 22. These operations may be assembly operations during a gas turbine engine assembly process. The operations may alternatively be maintenance operations during a gas turbine engine maintenance process. The method 1200 of the present disclosure, however, is not limited to any particular operations.

The engine case 22 may be included in various types and configurations of gas turbine engines. The engine case 22, for example, may be included in a geared gas turbine engine where a gear train connects one or more shafts to one or more rotors in a fan section, a compressor section and/or any other engine section. Alternatively, the engine case 22 may be included in a direct drive gas turbine engine configured without a gear train. The engine case 22 may be included in a gas turbine engine configured with a single spool, with two spools, or with more than two spools. The gas turbine engine may be configured as a turbofan engine, a turbojet engine, a turboprop engine, a turboshaft engine, a propfan engine, a pusher fan engine or any other type of gas turbine engine for propelling an aircraft. The gas turbine engine may alternative be configured as an auxiliary power unit (APU) or an industrial gas turbine engine. The present disclosure therefore is not limited to any particular types or configurations of gas turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A fixture assembly for holding a case of a gas turbine engine, comprising:

a support stand;

a support platform rotatably coupled to the support stand and rotatable about an axis, the support platform extending circumferentially about a centerline that is angularly offset from the axis, and the support platform extending longitudinally along the centerline to a platform top surface; and a platform adaptor disposed on the platform top surface and attached to the support platform, the platform adaptor comprising a case receptacle formed by an adaptor top surface and an adaptor shoulder surface, the platform adaptor extending longitudinally along the centerline to the adaptor top surface where the adaptor top surface is configured to longitudinally engage and support the case, the platform adaptor extending radially relative to the centerline to the adaptor shoulder surface where the adaptor shoulder surface is configured to radially engage and position the case on the adaptor top surface, and the adaptor top surface and the adaptor shoulder surface each extending circumferentially about the centerline;

wherein the support platform comprises an adaptor receptacle formed by the platform top surface and a platform shoulder surface;

wherein the platform top surface is configured to longitudinally engage and support the platform adaptor;

wherein the support platform extends radially relative to the centerline to the platform shoulder surface where the platform shoulder surface is configured to radially engage and position the platform adaptor on the platform top surface; and wherein the platform top surface and the platform shoulder surface each extend circumferentially about the centerline.

2. The fixture assembly of claim 1, wherein the platform adaptor extends radially outwards away from the centerline to the adaptor shoulder surface.

3. The fixture assembly of claim 1, wherein the platform adaptor extends radially inwards towards the centerline to the adaptor shoulder surface.

4. The fixture assembly of claim 1, further comprising a fastener configured to project sequentially longitudinally through a platform fastener aperture in the support platform and an adaptor fastener aperture in the platform adaptor and into a case fastener aperture in the case to mount the case to the fixture assembly.

5. The fixture assembly of claim 1, wherein the support platform comprises a platform fastener aperture;

the platform adaptor comprises an adaptor fastener aperture and an aperture indicator;

the adaptor fastener aperture is configured to align with the platform fastener aperture; and the aperture indicator is located along an outer periphery of the platform adaptor and, the aperture indicator is configured to mark a position of the adaptor fastener aperture.

6. The fixture assembly of claim 5, wherein the aperture indicator comprises a groove that projects radially relative to the centerline into a rim of the support platform.

7. The fixture assembly of claim 1, wherein the platform adaptor comprises an adaptor ring and an adaptor rim;

the adaptor ring comprises the adaptor top surface; and the adaptor rim projects longitudinally out from the adaptor ring and comprises the adaptor shoulder surface.

8. The fixture assembly of claim 1, wherein the support platform comprises a metal; and the platform adaptor comprises a polymer.

9. The fixture assembly of claim 1, wherein the support stand comprises a cart.

10. The fixture assembly of claim 1, wherein the support stand includes a first support arm and a second support arm;

the support platform is laterally between and rotatably coupled to the first support arm and the second support arm.

11. The fixture assembly of claim 10, further comprising:

a first mount rotatably coupled to the first support arm by a first pivot connection; and a second mount rotatably coupled to the second support arm by a second pivot connection, the second pivot connection and the first pivot connection coaxial along the axis;

the support platform laterally between and connected to the first mount and the second mount.

12. The fixture assembly of claim 1, wherein the support stand comprises a locking device configured to rotatably lock a position of the support platform about the axis.

13. The fixture assembly of claim 1, wherein the support stand comprises a gearbox configured to control a position of the support platform about the axis.

14. The fixture assembly of claim 1, wherein the support platform includes a first platform arm, a second platform arm and a platform ring laterally between the first platform arm and the second platform arm, the platform ring comprising the platform top surface;

the first platform arm projects out from the platform ring and is rotatably coupled to the support stand by a first pivot connection; and the second platform arm projects out from the platform ring and is rotatably coupled to the support stand by a second pivot connection.

15. A fixture assembly for holding a case of a gas turbine engine, comprising:

a support stand;

a support platform rotatably coupled to the support stand and rotatable about an axis, the support platform extending circumferentially about a centerline that is angularly offset from the axis, and the support platform extending longitudinally along the centerline to a platform top surface; and a platform adaptor disposed on the platform top surface and attached to the support platform, the platform adaptor comprising a case receptacle formed by an adaptor top surface and an adaptor shoulder surface, the platform adaptor extending longitudinally along the centerline to the adaptor top surface where the adaptor top surface is configured to longitudinally engage and support the case, the platform adaptor extending radially relative to the centerline to the adaptor shoulder surface where the adaptor shoulder surface is configured to radially engage and position the case on the adaptor top surface, and the adaptor top surface and the adaptor shoulder surface each extending circumferentially about the centerline;

wherein the platform adaptor comprises a plurality of keyhole slots arranged circumferentially about the centerline;

wherein the support platform comprises a plurality of protrusions;

wherein the plurality of protrusions are configured to respectively pass through the plurality of keyhole slots when the platform adaptor is at a first position about the centerline; and wherein the plurality of protrusions are configured to longitudinally attach the platform adaptor to the support platform when the platform adaptor is at a second position about the centerline.

16. The fixture assembly of claim 15, further comprising:

a lock element configured to mate with and extend longitudinally within a platform lock aperture in the support platform and an adaptor lock aperture in the platform adaptor when the platform adaptor is at the second position about the centerline; and wherein the platform lock aperture is misaligned with the adaptor lock aperture when the platform adaptor is at the first position about the centerline.

17. A method involving a case for a gas turbine engine, comprising:

selecting a first platform adaptor from a set of platform adaptors based on the configuration of the case;

disposing the first platform adaptor on a platform top surface of a support platform, the support platform extending circumferentially about a centerline, and the support platform extending longitudinally along the centerline to the platform top surface;

rotating the first platform adaptor about the centerline to attach the first platform adaptor to the support platform; and arranging the case with the first platform adaptor, the case abutted against and longitudinally supported by an adaptor top surface of the first platform adaptor, and the case abutted against and positioned on the adaptor top surface by an adaptor shoulder surface.

18. The method of claim 17, further comprising:

attaching the case to the support platform and the first platform adaptor using a fastener;

the fastener mated with fastener apertures in the support platform, the first platform adaptor and the case.

* * * * *